US010415326B2

(12) United States Patent
Chevalier et al.

(10) Patent No.: US 10,415,326 B2
(45) Date of Patent: Sep. 17, 2019

(54) DOWNHOLE DRILLING ASSEMBLY WITH CONCENTRIC ALIGNMENT FEATURE

(71) Applicants: Josh Chevalier, Littleton, CO (US); Chris Bairrington, Broomfield, CO (US)

(72) Inventors: Josh Chevalier, Littleton, CO (US); Chris Bairrington, Broomfield, CO (US)

( * ) Notice: Subject to any disclaimer, the term of this patent is extended or adjusted under 35 U.S.C. 154(b) by 118 days.

(21) Appl. No.: 15/334,552

(22) Filed: Oct. 26, 2016

(65) Prior Publication Data

US 2017/0114597 A1 Apr. 27, 2017

Related U.S. Application Data

(60) Provisional application No. 62/246,474, filed on Oct. 26, 2015.

(51) Int. Cl.

| | |
|---|---|
| ***E21B 17/10*** | (2006.01) |
| ***E21B 10/56*** | (2006.01) |
| ***E21B 17/16*** | (2006.01) |
| ***E21B 29/00*** | (2006.01) |

(52) U.S. Cl.
CPC ..... *E21B 17/1078* (2013.01); *E21B 10/56* (2013.01); *E21B 17/1092* (2013.01); *E21B 17/16* (2013.01); *E21B 29/00* (2013.01)

(58) Field of Classification Search
CPC combination set(s) only.
See application file for complete search history.

(56) References Cited

U.S. PATENT DOCUMENTS 3,482,889 A * 12/1969 Cochran ..... E21B 17/1078 175/325.5
4,991,654 A * 2/1991 Brandell ..... E21B 23/006 166/240
5,074,366 A * 12/1991 Karlsson ..... E21B 7/068 166/381
5,109,924 A * 5/1992 Jurgens ..... E21B 29/06 166/117.5
5,649,603 A * 7/1997 Simpson ..... E21B 4/18 166/241.3

(Continued)

OTHER PUBLICATIONS

Official Action for Canada Patent Application No. 2,946,497, dated Jan. 8, 2018 4 pages.

(Continued)

*Primary Examiner* — Cathleen R Hutchins
*Assistant Examiner* — Ronald R Runyan
(74) *Attorney, Agent, or Firm* — Sheridan Ross P.C.

(57) ABSTRACT

A concentric alignment device is provided that elevates the working face of a drill bit off of the inner wall of a casing or tubing to prevent premature wear of the working face of the drill bit. In horizontal drilling applications, the working face of a drill bit has a tendency to contact or rest on the inner wall of a casing or tubing, which negatively affects the working face of a drill bit. In some embodiments, one or more optional inserts are provided on the shank of a drill bit or on a centralizing sub such that the inserts contact the inner wall of a casing or tubing instead of the working face of the drill bit. In other embodiments, blade packages on a drill bit or sub contact the inner wall of a casing or tubing and also pump drilling fluid in a downhole direction.

4 Claims, 5 Drawing Sheets

(56) References Cited

U.S. PATENT DOCUMENTS

| | | | | |
|---|---|---|---|---|
| 6,209,638 | B1 * | 4/2001 | Mikolajczyk | E21B 17/1028 166/241.1 |
| 6,695,058 | B1 * | 2/2004 | French | E21B 21/002 166/173 |
| 8,505,624 | B2 * | 8/2013 | Levie | E21B 17/1028 166/241.1 |
| 8,590,644 | B2 | 11/2013 | Hall et al. | |
| 2008/0169107 | A1 * | 7/2008 | Redlinger | E21B 17/1014 166/382 |
| 2010/0044110 | A1 * | 2/2010 | Bangru | C23C 14/0605 175/61 |
| 2011/0114338 | A1 * | 5/2011 | Casassa | E21B 17/1042 166/382 |
| 2015/0354306 | A1 * | 12/2015 | Fuller | E21B 29/005 166/285 |

OTHER PUBLICATIONS

Official Action for Canada Patent Application No. 2,946,497, dated Apr. 17, 2018 4 pages.

* cited by examiner

DOWNHOLE DRILLING ASSEMBLY WITH CONCENTRIC ALIGNMENT FEATURE

CROSS-REFERENCE TO RELATED APPLICATIONS

This application claims priority under 35 U.S.C. § 119(e) to U.S. Provisional Patent Application Ser. No. 62/246,474 filed Oct. 26, 2015, which is incorporated herein in its entirety by reference.

FIELD OF THE INVENTION

The present invention relates to drilling assemblies and centralizing subs with one or more inserts that raise a working face of a drill bit off of an inner surface of a casing or tubing.

BACKGROUND OF THE INVENTION

The drill bit is a critical component in oil, gas, and geothermal drilling. The drill bit is fitted to the end of a drill string, and a working face of the drill bit typically comprises tungsten carbine or diamond coated surfaces that cut and chip subterranean formations. The drill pipe and drill collars are positioned above the drill bit to steer and direct the drill bit as the drill string is pushed into the earth. Accordingly, the cross sectional area or outer diameter of the working face of the drill bit is larger than the cross sectional area or outer diameter of the other components in the drill string. Otherwise, these components would not fit down the wellbore as the drill string is pushed into the earth, and the drill string could become stuck in the wellbore at significant expense.

Once a wellbore is drilled, a casing is typically lowered into the wellbore and cemented in place to help preserve the integrity of the wellbore against collapse, and more importantly to isolate the wellbore from various oil and gas reservoirs and water aquifers. Production tubing may be run internally through the casing string to provide a constant and continuous bore from the production zone to the wellhead.

Historically, wellbores were drilled in a substantially vertical direction or at a moderate angle below the surface location. However, the advent of horizontal drilling has changed this paradigm. With horizontal drilling, a drill string and the resulting wellbore can change directions. For example, at a given depth, the drill string and the wellbore may be oriented substantially horizontally. Horizontal drilling provides many benefits including increasing the exposure of the well to a reservoir over an extended distance, grouping wellheads at a central location to reduce the surface area or footprint needed to conduct drilling operations, and drilling underneath natural and man-made obstacles.

Hydraulic fracturing is another technology that has improved the production of oil and gas wells. Hydraulic fracturing is a process where fluid and sand or ceramic beads are pumped down into the wellbore at very high pressures. The interaction between the high pressure fluid and the target subterranean formation fractures rock, which creates cracks and fissures that release oil and gas. The combination of horizontal drilling and hydraulic fracturing has led to a renaissance in North American oil and gas drilling and significant increases in production and ultimate hydrocarbon recovery.

In some North American shale reservoirs, e.g., the Bakken and Marcellus reservoirs, hydraulic fracturing is performed in substantially horizontal wellbores at predetermined production intervals. Fracturing plugs are set at various points in the wellbore to temporarily seal off intervals for hydraulic fracturing treatment. Once the hydraulic fracturing is performed, a drill bit with a working face is used to drill through the fracturing plug and provide access to the recently-treated interval.

An issue with drilling through a fracturing plug is that the working face of the drill bit and the overall bit housing diameter are smaller than the cross sectional area or inner diameter of the casing or tubing that the fracturing plug is positioned in. In addition, the cross sectional area and/or outer diameter of the working face or housing of the drill bit is larger than the other components of the drill string, which is the standard or norm during drilling. Within a horizontal or deviated wellbore, this results in the drill bit contacting and wearing against one side of the casing or tubing. Since wellbores may be miles long, this contact can lead to premature wearing of the working face of the drill bit and other components of the drill bit such as the shank of the drill bit.

Another issue is that once the drill bit reaches the fracturing plug, the drill bit is not aligned with the fracturing plug to properly drill out the fracturing plug. More specifically, fracturing plugs are typically made from plastic and composite materials which are designed to be frangible and drilled out after serving their useful purpose. Fracturing plugs are optimally drilled through the center of the fracturing plug so that the fracturing plug is reduced to many small pieces and returned to the surface. However, with currently existing drill bits and drill strings, the drill bit is ineffectively aligned with one edge of the fracturing plug positioned on the low side of a deviated wellbore. Thus, the resulting drilling operation of the fracturing plug is ineffective and inefficient, taking additional time and adding expense to the wellbore operation.

These deficiencies, among others, are addressed in the present invention described in detailed below.

SUMMARY OF THE INVENTION

It is therefore an aspect of the present invention to provide devices, systems, and methods to elevate a working face of a drill bit off of an inner surface of a casing or tubing and substantially align the drill bit with a fracturing plug in the casing or tubing. In some embodiments, the alignment of the drill bit with the casing or tubing is utilized to prevent damage to the drill bit and to more effectively drill through fracturing plugs. However, it will be appreciated that embodiments of the present invention may also be used in other applications.

It is one aspect of the present invention to provide a bottom hole drilling assembly with a drill bit that has one or more inserts provided on the shank of the drill bit. The one or more inserts provided on the shank of the drill bit have a cross sectional area or outer diameter that is larger than a cross sectional area or outer diameter of the working face of the drill bit. Therefore, the one or more inserts contact the inner surface of the casing or the tubing rather than the working face or other component of the drill bit. This preserves the drill bit and substantially aligns an axis of the drill bit with a centerline or longitudinal axis of the casing or tubing.

It will be appreciated that one or more inserts may be positioned on other components of the drill string immediately above the drill bit. Therefore, it is another aspect of the present invention to provide a centralizing sub that has one or more inserts or an external diameter which is greater than the maximum external diameter of the drill bit. The centralizing sub may be positioned adjacent to the drill bit to prevent the drill bit from contacting the inner surface of the casing or tubing and to align the drill bit with the fracturing plug. However, it will be appreciated that the centralizing sub may be placed in other locations in the drill string proximate to the drill bit.

In some embodiments of the present invention, other components in the drill string such as drill collars may elevate the drill bit off of the inner surface of the casing or tubing. Drill collars are typically positioned between the drill bit and the drill string, and drill collars serve several functions in the drilling operation. Drill collars can angle the drill bit relative to the drill string to steer the drill bit, and drill collars can add weight onto the drill bit to facilitate the drilling operation. Accordingly, drill collars in some embodiments of the present invention may have a cross sectional area or outer diameter that is greater than the cross sectional area or outer diameter of the working face of the drill bit, but less than or equal to the cross sectional area or inner diameter of the casing or tubing. In addition, drill collars may have a cross sectional area of outer diameter that is less than the cross sectional area or outer diameter of the other components in the drill string such as the drill pipes. It will be appreciated that some embodiments of the present invention may optionally include drill collars and that a centralizing sub may be a drill collar.

It is an aspect of embodiments of the present invention to provide various configurations of one or more inserts. In some embodiments, the insert is a single, continuous insert that circumscribes a perimeter of a drill bit shank, a centralizing sub, etc. Further embodiments may include a plurality of continuous inserts set at various perimeters of the drill bit shank. In some embodiments, the one or more inserts are discrete, non-continuous inserts. A set of inserts may be equally-spaced about a perimeter of a drill bit shank, a centralizing sub, etc. It will be appreciated that the inserts may not be equally-spaced and that there may be multiple sets of inserts about multiple perimeters.

It is an aspect of some embodiments of the present invention to provide one or more blade packages on the outer surface of a centralizing sub, drill collar, etc. A blade package can comprise a plurality of blades raised above the outer surface of the centralizing sub where channels are formed between the blades. The blades define a cross sectional area that is larger than the working end of the drill bit, or alternatively, the minimum diameter of the blades is greater than the maximum diameter of the working end of the drill bit so the blades raise the drill bit off of an inner surface of a casing or tubing. The blades can be angled with respect to a longitudinal axis of the centralizing sub so that the blades and channels turn or rotate in a first direction about the longitudinal axis. This direction can be aligned with or be opposed to the direction that the centralizing sub turns during operation. In the case where the blades rotate in an opposing direction, the blades pump some of the drilling fluid in a downhole direction. Therefore, when the drill bit breaks a fracturing plug, the fracturing plug remnants contact the blade packages and churn at the leading portion of the blades to further break up the fracturing plug remnants. It will be appreciated that there are many different numbers of blade packages, positions of blade packages, blade angles, blade rotation directions, etc.

One particular embodiment of the invention is a bottom hole drilling assembly used in a wellbore, comprising a drill bit having a working face that defines a first cross sectional area; a centralizing sub operatively interconnected to the drill bit, the centralizing sub having an outer surface; at least one insert positioned on the outer surface of the centralizing sub, the at least one insert defining a second cross sectional area, wherein the second cross sectional area is larger than the first cross sectional area.

In some embodiments, the at least one insert has a first insert that circumscribes a first perimeter of the outer surface of the centralizing sub and has a second insert that circumscribes a second perimeter of the outer surface of the centralizing sub. In various embodiments, a maximum outer diameter of the working face of the drill bit is less than a minimum outer diameter of the at least one insert. In some embodiments, the centralizing sub is a drill collar.

In various embodiments, the at least one insert comprises a blade package, the blade package defining the second cross sectional area, the blade package having a plurality of blades, wherein each blade forms a blade angle relative to a longitudinal axis of the centralizing sub. In some embodiments, the centralizing sub is configured to rotate in a first direction, the blades of the blade package are configured to rotate in a second direction of the centralizing sub, wherein the first direction and the second direction are distinct, and wherein the blades are configured to drive a drilling fluid in a downhole direction. In various embodiments, the assembly further comprises a second blade package positioned on the outer surface of the centralizing sub, the second blade package having a plurality of second blades, wherein each of the second blades forms a second blade angle relative to the longitudinal axis of the centralizing sub, and wherein the second blades of the second blade package are configured to rotate in the second direction. In some embodiments, the at least one insert has a coating with a friction coefficient that is less than a friction coefficient of the centralizing sub.

Another particular embodiment of the invention is a drill bit for wellbore operations, comprising a shank having a distal end and a proximate end; a working face positioned on the distal end of the shank, the working face comprising one or more drilling cones or surfaces, and the working face defining a first cross sectional area; and at least one insert positioned on an outer surface of the shank between the distal end and the proximate end of the shank, the at least one insert defining a second cross sectional area, wherein the second cross sectional area is larger than the first cross sectional area.

In various embodiments, the at least one insert is a continuous insert that circumscribes a perimeter of an outer surface of the shank. In some embodiments, the shank comprises at least one insert positioned on a second perimeter of an outer surface of the shank. In various embodiments, a maximum outer diameter of the working face of the drill bit is less than a minimum outer diameter of the at least one insert. In some embodiments, the at least one insert has a blade package, the blade package defining the second cross sectional area, the blade package having a plurality of blades, wherein each blade forms a blade angle relative to a longitudinal axis of the centralizing sub. In various embodiments, a plurality of channels is formed between the blades of the plurality of blades, and the drill bit is configured to eject a drilling fluid from the working face and pass the drilling fluid through the plurality of channels.

Yet another particular embodiment of the invention is a centralizing sub for centering a drill bit in a wellbore, comprising a body having an uphole end, a downhole end, an outer surface extending between the uphole end and the downhole end, a diameter, and a longitudinal axis; a blade package positioned on the outer surface of the body, the blade package having a diameter that is larger than the diameter of the body, the blade package having a plurality of blades, wherein each blade forms a blade angle relative to the longitudinal axis of the body; wherein the body is configured to rotate in a first direction, the blades of the blade package are configured to rotate in a second direction, and wherein the first direction and the second direction are distinct such that the blades are configured to drive a drilling fluid in a downhole direction.

In some embodiments, the centralizing sub further comprises a second blade package positioned on the outer surface of the body, the second blade package having a diameter that is larger than the diameter of the body, the second blade package having a plurality of second blades, wherein each second blade forms a second blade angle relative to the longitudinal axis of the body. In various embodiments, the second blades of the second blade package rotate in the second direction. In some embodiments, a spacer portion of the body is positioned between the blade packages, and the spacer portion is a predetermined length of the body. In various embodiments, the blade package has four blades, and each blade has a blade height between approximately 4 and 7 inches. In some embodiments, each blade has a blade width of approximately 1 foot, and each blade has a radiused side edge, wherein a radius of the radiused side edge is between approximately 3 and 4 inches.

These and other advantages will be apparent from the disclosure of the present invention(s) contained herein. The above-described embodiments, objectives, and configurations are neither complete nor exhaustive. The Summary of the Invention is neither intended nor should it be construed as being representative of the full extent and scope of the present invention. Moreover, references made herein to "the present invention" or aspects thereof should be understood to mean certain embodiments of the invention and should not necessarily be construed as limiting all embodiments to a particular description. The present invention is set forth in various levels of detail in the Summary of the Invention as well as in the attached drawings and Detailed Description and no limitation as to the scope of the present invention is intended by either the inclusion or non-inclusion of elements, components, etc. in this Summary of the Invention. Additional aspects of the present invention will become more readily apparent from the Detailed Description particularly when taken together with the drawings.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures.

Figure 1:
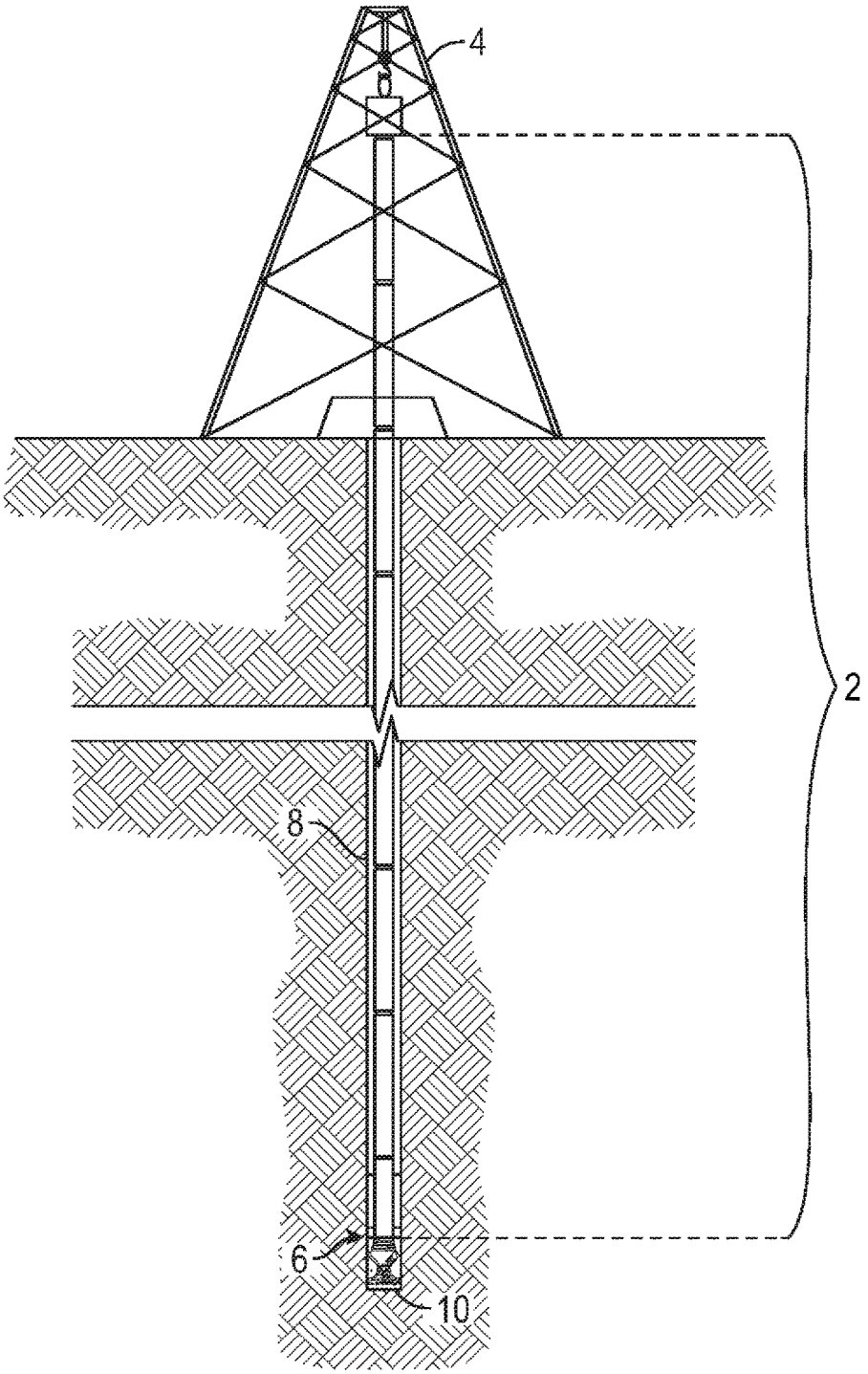
FIG. 1 is a cross sectional elevation view of a derrick and a drill string in accordance with the prior art.

To assist in the understanding of the embodiments of the present invention the following list of components and associated numbering found in the drawings is provided herein:

| Component No. | Component |
|---|---|
| 2 | Drill String |
| 4 | Derrick |
| 6 | Bottom Hole Assembly |
| 8 | Wellbore |
| 10 | Drill Bit |
| 12 | Fracturing plug |
| 14 | Casing |
| 16 | Inner Surface |
| 18 | Working Face |
| 20 | Drilling Surface |
| 22 | Drill Bit Axis |
| 24 | Casing Axis |
| 26 | Insert |
| 28 | Drill Bit Area |
| 30 | Insert Area |
| 32 | Centralizing Sub |
| 34 | Blade Package |
| 36 | Blade |
| 38 | Blade Angle |
| 40 | Spacer |
| 42 | Sub Length |
| 44 | Sub Diameter |
| 46 | Blade Package Diameter |
| 48 | First Offset |
| 50 | Spacer Length |
| 52 | Second Offset |
| 54 | Blade Width |
| 56 | Blade Height |
| 58 | Blade Radius |

It should be understood that the drawings are not necessarily to scale, and various dimensions may be altered. In certain instances, details that are not necessary for an understanding of the present invention or that render other details difficult to perceive may have been omitted. It should be understood, of course, that the present invention is not necessarily limited to the particular embodiments illustrated herein.

DETAILED DESCRIPTION

The present invention has significant benefits across a broad spectrum of endeavors. It is the Applicant's intent that this specification and the claims appended hereto be accorded a breadth in keeping with the scope and spirit of the present invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the present invention into practice is described herein by, and with reference to, the annexed drawings that form a part of the specification. The exemplary embodiment is described in detail without attempting to describe all of the various forms and modifications in which the present invention might be embodied. As such, the embodiments described herein are illustrative, and as will become apparent to those skilled in the arts, and may be modified in numerous ways within the scope and spirit of the present invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Various embodiments of the present invention are described herein and as depicted in the drawings. It is expressly understood that although the figures show drill bits, inserts, centralizing subs, and other components, the present invention is not limited to these embodiments.

Now referring to FIG. 1, a perspective view of a prior art drill string 2 suspended by a derrick 4 is provided. A bottom hole assembly 6 is located at the bottom of a wellbore 8, and the bottom hole assembly 6 comprises a drill bit 10. As the drill bit 10 rotates downhole, the drill string 4 advances further into the earth. The drill string 4 may penetrate soft or hard subterranean formations, and the drill bit 10 may break up the formations by cutting and/or chipping the formation during a downhole drilling operation. The drill string 4 behind the drill bit 10 has a smaller cross sectional area or outer diameter than the drill bit 10, specifically a working face of the drill bit 10, to prevent the other components of the drill string 4 from interfering with the downhole drilling of the wellbore 8.

Figure 2:
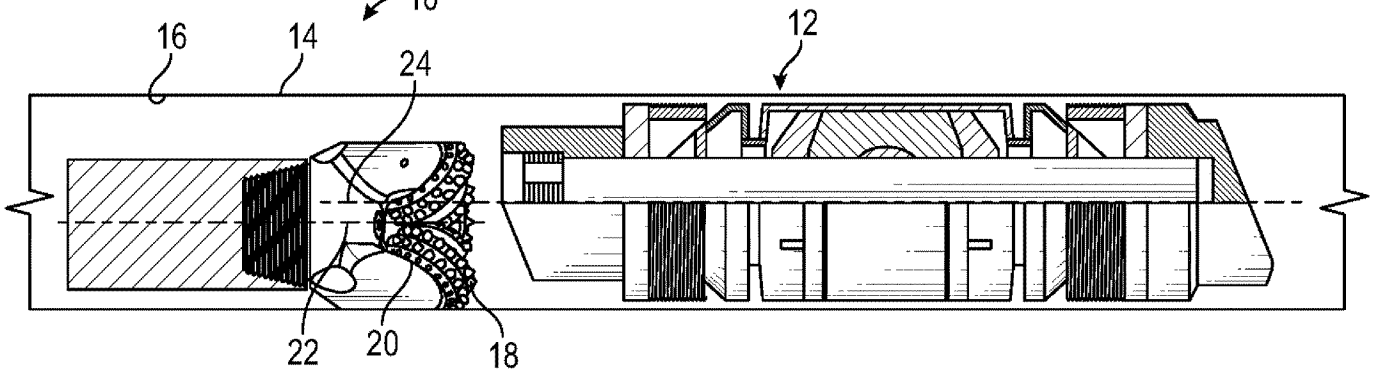
FIG. 2 is a cross sectional view of a casing string with a fracturing plug and a drill bit positioned therein in accordance with the prior art.

Now referring to FIG. 2, a cross sectional elevation view of a prior art casing 14 with a fracturing plug 12 and a drill bit 10 is provided. The fracturing plug 12 is positioned within the casing 14 to obstruct the casing 14 and set up one or more intervals along the wellbore for hydraulic fracturing. The drill bit 10 at the end of a drill string has been lowered downhole and down the casing 14 to drill out the fracturing plug 12. However, the drill bit 10 has a working face 18 that includes one or more drilling cones or surfaces 20 for cutting and chipping subterranean formations where the cross sectional area or outer diameter of the working face 18 is larger than the other components of the drill string. Since the wellbore in FIG. 2 is horizontal, the working face 18 of the drill bit 10 contacts the inner surface 16 of the casing 14. A wellbore may be miles long, and this contact causes premature wear and tear on the drill bit 10.

In addition, the drill bit 10 is out of alignment with the casing 14 and the fracturing plug 12. The drill bit 10 has a drill bit axis 22 and the casing 14 has a casing axis 24. As shown in FIG. 2, these axes 22, 24 are not substantially aligned. As a result, the drill bit 10 will drill out a lower portion of the fracturing plug 12. This is not effective because the fracturing plug 12 is typically plastic and composite, and the drill bit 10 must break the fracturing plug 12 into small pieces that travel back to the surface during circulation of wellbore fluids. In the embodiment in FIG. 2, the drill bit 10 will not drill a top portion of the fracturing plug 12 into smaller pieces. The result is a less effective clearance of the fracturing plug 12.

Figure 3:
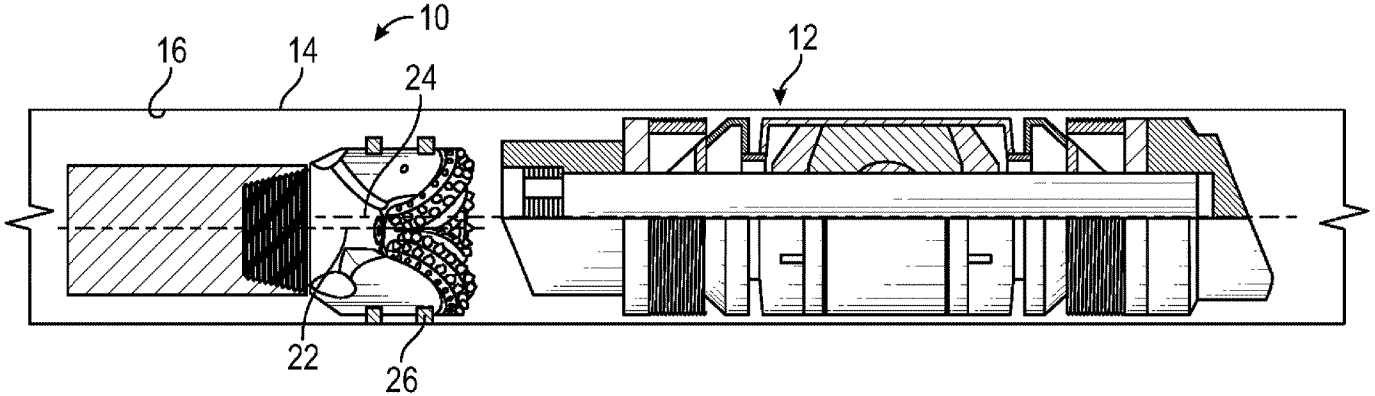
FIG. 3 is a cross sectional view of a casing with a drill bit having at least one insert in accordance with various embodiments of the invention.

Now referring to FIG. 3, a cross sectional elevation view of a casing 14 is provided where a drill bit 10 of the present invention is centralized using one or more inserts 26. In this embodiment of the present invention, the inserts 26 extend outward from a shank of the drill bit 10, and the inserts 26 create a cross sectional area or outer diameter that is larger than the cross sectional area or outer diameter of the working face of the drill bit 10. As a result, the working face of the drill bit 10 is raised off of the inner surface 16 of the casing 14 to prevent wear to the drill bit 10.

The drill bit 10 is also substantially aligned with the casing 14 and the fracturing plug 12. The inserts 26 raise the drill bit 10 upward, and the drill bit axis 22 is substantially aligned with the casing axis 24. This alignment provides a more effective and complete drilling of the fracturing plug 12.

The one or more optional inserts 26 may have a variety of configurations. In some embodiments, an insert 26 may be a single, continuous insert 26 that circumscribes a perimeter of a drill bit 10. In further embodiments, additional continuous inserts 26 may be positioned at other perimeters along the drill bit 10. Other inserts 26 may be non-continuous and discrete. A plurality of these inserts 26 may be arrayed about a perimeter of the drill bit 10, using equal or unequal spacing. It should be understood that these inserts 26 may be positioned about different perimeters, using different spacing, etc.

The inserts 26 may also come in a variety of sizes. As shown in FIG. 3, the one or more inserts 26 may have a cross sectional area or outer diameter that is greater than the cross sectional area or outer diameter of the working face of the drill bit 10, but is less than the cross sectional area or inner diameter of the casing 14. Thus, the one or more inserts 26 raise the working face of the drill bit 10 off of the casing 14 but do not completely align the drill bit axis 22 with the casing axis 24. This prevents wear to the drill bit 10 and minimizes friction between the one or more inserts 26 and the inner surface 16 of the casing 14.

In other embodiments, the one or more inserts 26 may have a cross sectional area or outer diameter that is equal to the cross sectional area or inner diameter of the casing 14. In these embodiments, the drill bit axis 22 is aligned with the casing axis 24, but the entire outer surface of the one or more inserts 26 creates friction with the entire inner surface 16 of the casing 14. One skilled in the art will appreciate the tradeoffs between these, and other, configurations of the one or more inserts 26.

The inserts 26 may be made from a variety of materials. These materials may be rigid enough to raise the drill bit 10 off of an inner surface 16 of casing 14 and structurally resist wear as the inserts 26 travel down a wellbore, casing, tubing, etc. In addition, the material or materials of the insert 26 may have a low friction coefficient to lower frictional resistance as the drill string travels down the wellbore. The inserts 26 may be made from materials including, but not limited to, polytetrafluoroethylene, polychlorotrifluoroethylene, perfluoroalkoxy, tetrafluorethylene-perfluoropropylene, chlorotrifluoroethylene, perfluorooctanoic acid, octylcyanoacrylate, and combinations thereof. The inserts 26 may also be a composite of multiple materials. For example, a top layer of low friction material may be secured to a metal structure to from an insert 26.

Figure 4A:
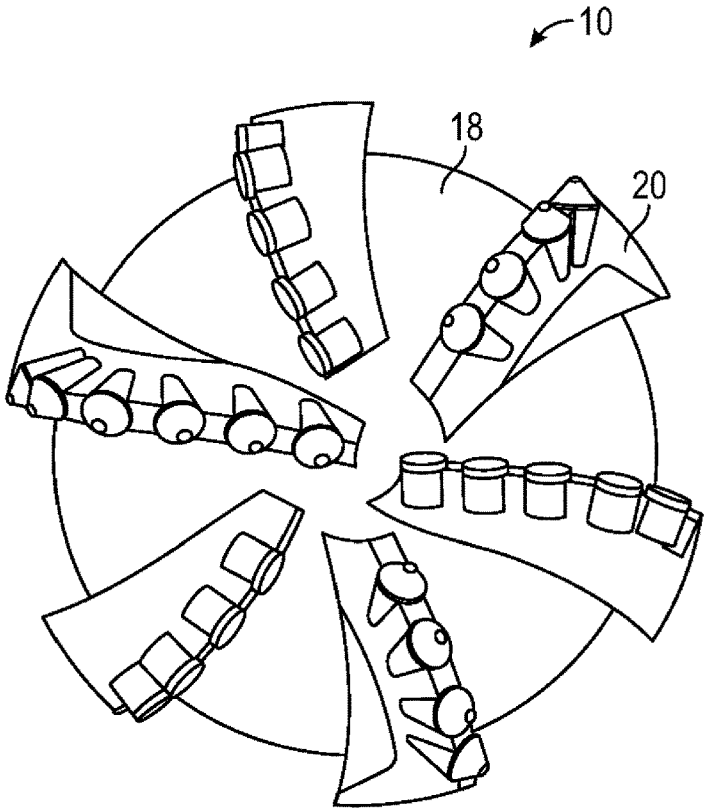
FIG. 4A is a front elevation view of a working face of a drill bit in accordance with various embodiments of the invention.

Now referring to FIG. 4A, a front elevation view of the working face 18 of a drill bit 10 is provided. This view is provided down a central or longitudinal axis of the drill bit 10. The working face 18 and the drilling cones or surfaces 20 on the working face 18 combine to define a cross sectional area, which is larger than other components of the drill string during initial wellbore drilling operations. However, as explained above, this configuration is not effective for post-wellbore drilling operations.

Figure 4B:
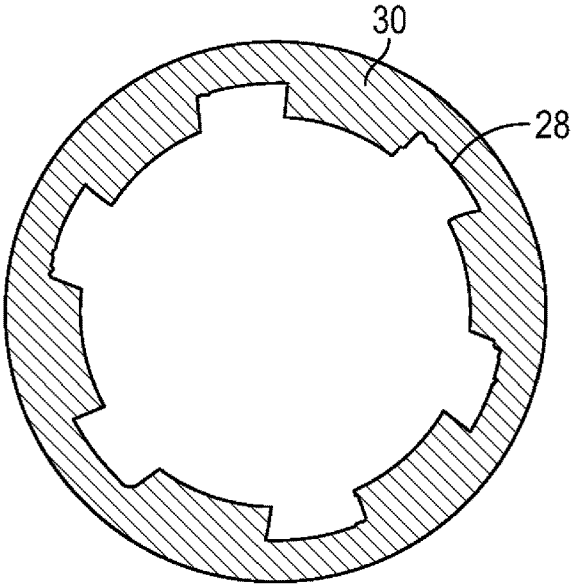
FIG. 4B is a front elevation view of a drill bit area and an insert area in accordance with various embodiments of the invention.

Now referring to FIG. 4B, a front elevation view of a drill bit area 28 and an insert area 30 is provided. This view is also provided down a central or longitudinal axis of the drill bit 10. The cross sectional area 28 of the working face 18 of the drill bit is less than the cross sectional area 30 of the one or more inserts. In addition, the cross sectional area 28 of the working face 18 of the drill bit has a maximum outer diameter defined by the drilling cones or surfaces, and this outer diameter does not extend past the cross sectional area 30 of the one or more inserts and risk contact with the inner surface of a casing or tubing. Stated in another similar way, the maximum outer diameter of the working face 18 of the drill bit is less than the minimum diameter of the one or more inserts. This configuration keeps the working face of the drill bit off of the inner surface of the casing and substantially aligns the drill bit axis with the casing axis.

Figure 5:
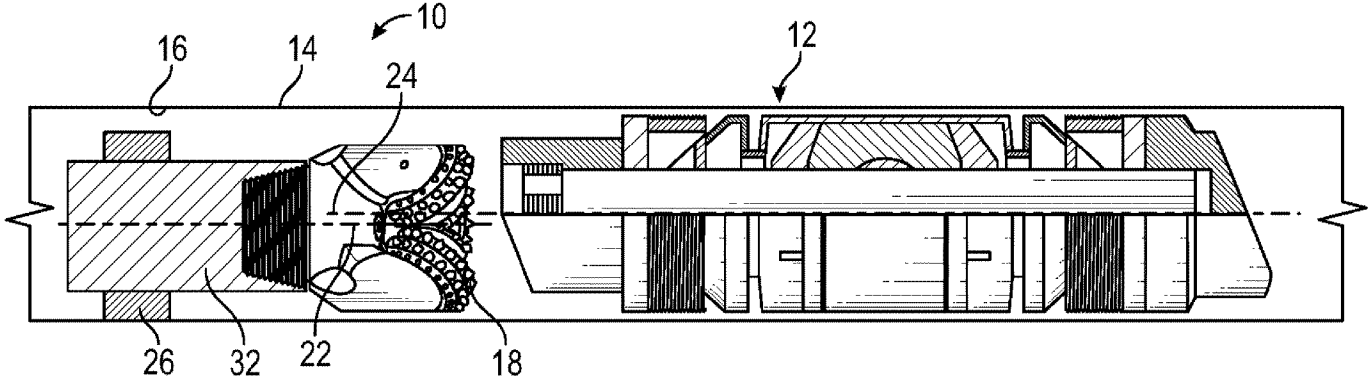
FIG. 5 is a cross sectional view of a casing string with a centralizing sub and a drill bit positioned opposite to a fracturing plug in accordance with various embodiments of the invention.

Now referring to FIG. 5, a cross sectional elevation view of a casing 14 is provided where a centralizing sub 32 has centralized a drill bit 10. One or more inserts 26 may be positioned on an outer surface of the centralizing sub 32 as described with respect to the one or more inserts 26 positioned on the drill bit 10. The centralizing sub 32 may be positioned adjacent to the drill bit 10 in the drill string. However, it will be appreciated that the centralizing sub 32 may be positioned at any point on the drill string to raise the working face of the drill bit 10 off of the inner face 16 of the casing 14 and to substantially align the drill bit axis 22 with the casing axis 24. As can be further appreciated, in some embodiments the centralizing sub is a drill collar.

Figure 6:
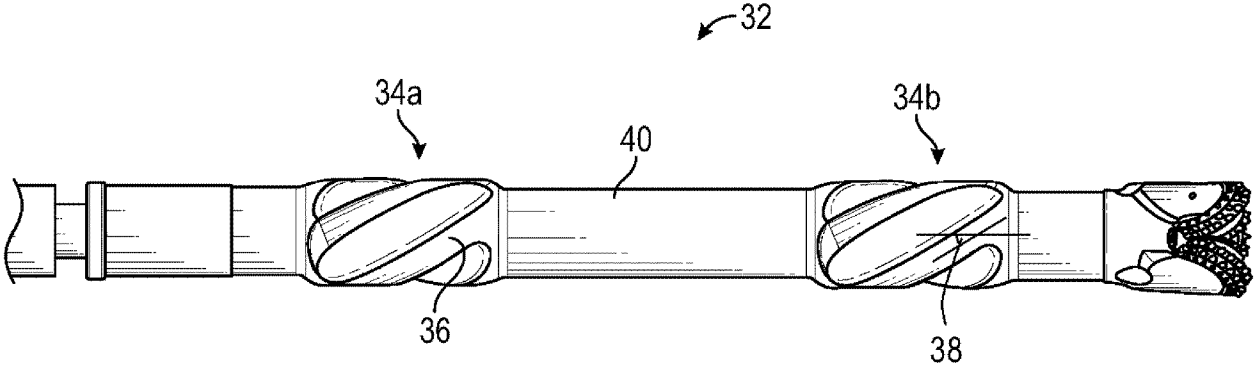
FIG. 6 is a side elevation view of a centralizing sub immovable blade packages in accordance with various embodiments of the invention.

FIGS. 6-7C show a centralizing sub 32 with blade packages 34*a*, 34*b* positioned on an outer surface of the centralizing sub 32. The blade packages 34*a*, 34*b* perform several functions including raising the drill bit off of the inner surface of a casing or tubing. Similar to the inserts 26, the blade packages 34*a*, 34*b* have an outer diameter or cross sectional area that is larger than the outer diameter or cross sectional area of the working face of the drill bit. Thus, when the wellbore runs in a horizontal orientation, the blade packages 34*a*, 34*b* contact the inner surface of the casing rather than the working face of the drill bit, which preserves the drill bit and aligns the drill bit with any fracturing plugs in the wellbore.

In some embodiments, the centralizing sub 32 may have a single blade package 34, and in some embodiments, the centralizing sub 32 may have multiple blade packages 34. With multiple blade packages, the centralizing sub 32 avoids a fulcrum effect with one blade package where the single blade package raises the drill bit off of one surface inside the casing but causes the drill bit to contact an opposite surface inside the casing. With multiple blade packages, a spacer 40 between the packages can flex to keep the drill bit away from every surface inside of the casing or tubing.

Another function of the blade packages 34*a*, 34*b* is to churn and further break up the fracturing plug as drilling fluid flows back up to the surface of the wellbore. During operation, a drilling fluid flows through the center of the drill string and exits the working face of the drill bit. The broken material and drilling fluid flows back to the top of the wellbore in the annular space between the drill string and the casing. So when the drill bit breaks up a fracturing plug, the remnants of the fracturing plug travel with the drilling fluid in the annular space. However, the remnants of the fracturing plug can physically obstruct wellbore operations as they travel with the drilling fluid.

Therefore, the blade packages 34*a*, 34*b* have a plurality of blades 36 that form channels through which the drilling fluid and the fracturing plug remnants can flow past the blade packages 34*a*, 34*b*. In addition, the rotational motion of centralizing sub 32 causes the blades 36 to strike the fracturing plug remnants and break the fracturing plug remnants into small sizes. The blades 36 are oriented at a blade angle 38 relative to the longitudinal axis of the centralizing sub 32. As shown in FIG. 6, the blade angle 38 is approximately 30 degrees. It will be appreciated that in some embodiments, the blade angle 38 can be between 0 and 90 degrees.

The blades 36 in the blade packages 34*a*, 34*b* can be oriented to rotate with the rotation of the centralizing sub 32, rotate against the rotation of the centralizing sub 32, or in some embodiments, different blade packages 34*a*, 34*b* can rotate in different directions. When the blades 36 of the blade packages 34*a*, 34*b* rotate against the centralizing sub 32, the blade packages 34*a*, 34*b* push drilling fluid back toward the drilling bit. This cycles the fracturing plug remnants against the blades 36 to reduce the fracturing plug remnants to an even smaller size. The diameter of the blade packages 34*a*, 34*b* can be approximately the same size as the diameter of the casing or tubing so that the blade packages 34*a*, 34*b* contact the inner surface of the casing and propel the drill string downhole, or alternatively, inhibit travel of the drill string downhole. It will be appreciated that the blade packages 34*a*, 34*b* may have a diameter that is larger, the same, or smaller than the diameter of the casing or tubing that it is positioned in.

The blades 36 can be enhanced with a coating that in some embodiments increases friction, and in some embodiments, decreases friction. With increased friction, blade packages can draw tubing down a wellbore. With decreased friction, the blades 36 and blade packages experience less wear. It will be further appreciated the blade packages on the centralizing sub 32 can allow compatibility with all bottom hole assemblies.

Figure 7A:
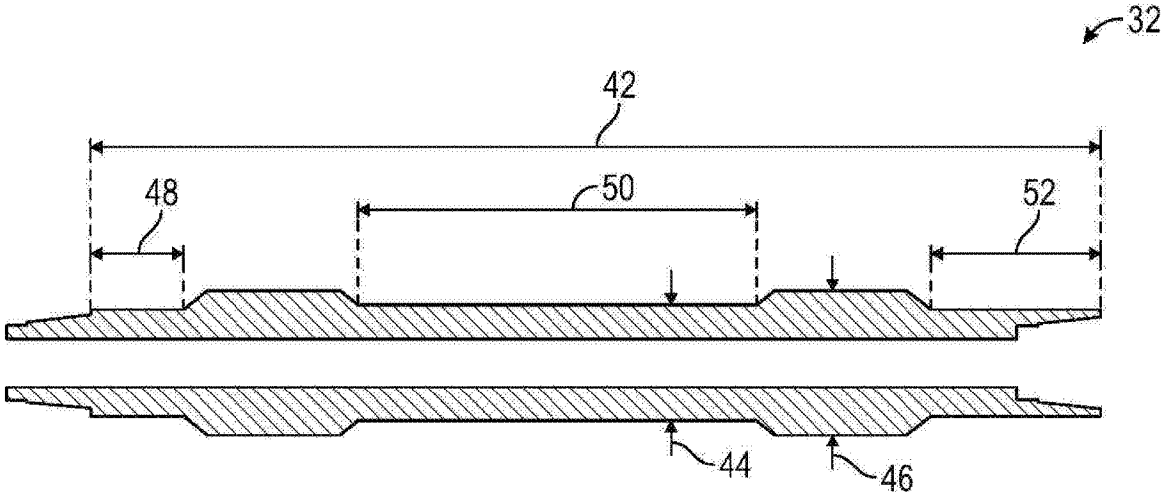
FIG. 7A is a cross sectional view of a centralizing sub with blade packages in accordance with various embodiments of the invention.

Now referring to FIG. 7A, a cross sectional view of the centralizing sub 32 is provided, and various dimensions of the centralizing sub 32 are identified. In some embodiments, a sub length 42 can be between approximately 24 and 48 feet. In various embodiments, the sub length 42 can be approximately 36 feet. In some embodiments, a sub diameter 44 can be between approximately 1 and 5 feet. In various embodiments, the sub diameter 44 can be approximately 3.500 feet or 3.125 feet. In some embodiments, a blade package diameter 46 can be between approximately 2 and 6 feet. In various embodiments, the blade package diameter 46 can be approximately 3.665 feet or 4.560 feet.

Next, in some embodiments, a first offset 48 between a blade package and a first end of the centralizing sub 32 can be between approximately 1 and 5 feet. In various embodiments, the first offset 48 can be approximately 3.250 feet. A spacer length 50 between the blade packages can be between approximately 10 and 20 feet. In various embodiments, the space length 50 can be approximately 14.250 feet. In some embodiments, a second offset 52 between a blade package and a second end of the centralizing sub 32 can be between approximately 4 and 8 feet. In various embodiments, the second offset 52 can be approximately 6 feet.

Figure 8:
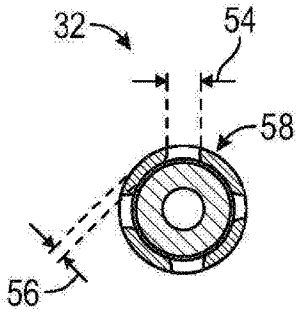
FIG. 8 is a cross sectional, front elevation view of centralizing sub in accordance with various embodiments of the invention.
Figure 7B:
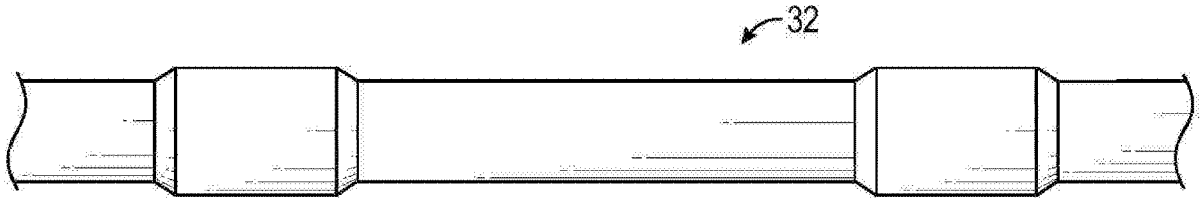
FIG. 7B is a side elevation view of a centralizing sub with blade packages in accordance with various embodiments of the invention.

FIG. 7B is a side elevation view of the centralizing sub 32, and FIG. 8 is a cross sectional view of a centralizing sub 328 shows various dimensions of the blades 36 of a blade package. In some embodiments, the blade width 54 can be between approximately 0.5 and 1.5 feet. In various embodiments, the blade width 54 can be approximately 1 foot. In some embodiments, a blade height 56 can be between approximately 0.1 and 2 feet. In various embodiments, the blade height 56 can be approximately 0.530 feet. A blade radius 58 formed between the blade and a channel can be between approximately 0.1 and 1 foot. In various embodiments, the blade radius 58 can be approximately 0.3 feet. It will be appreciated that the dimensions herein are exemplary and non-limiting in nature.

The present invention has significant benefits across a broad spectrum of endeavors. It is the Applicant's intent that this specification and the claims appended hereto be accorded a breadth in keeping with the scope and spirit of the present invention being disclosed despite what might appear to be limiting language imposed by the requirements of referring to the specific examples disclosed.

The phrases "at least one", "one or more", and "and/or", as used herein, are open-ended expressions that are both conjunctive and disjunctive in operation. For example, each of the expressions "at least one of A, B, and C", "at least one of A, B, or C", "one or more of A, B, and C", "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification, drawings, and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having," and variations thereof, is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts, and the equivalents thereof, shall include all those described in the summary of the present invention, brief description of the drawings, detailed description, abstract, and claims themselves.

The foregoing description of the present invention has been presented for illustration and description purposes. However, the description is not intended to limit the present invention to only the forms disclosed herein. In the foregoing Detailed Description for example, various features of the present invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the present invention.

Consequently, variations and modifications commensurate with the above teachings and skill and knowledge of the relevant art are within the scope of the present invention. The embodiments described herein above are further intended to explain best modes of practicing the present invention and to enable others skilled in the art to utilize the invention in such a manner, or include other embodiments with various modifications as required by the particular application(s) or use(s) of the present invention. Thus, it is intended that the claims be construed to include alternative embodiments to the extent permitted by the prior art.

The invention claimed is:

1. A bottom hole drilling assembly for removing an obstruction in a subterranean, inclined wellbore lined with a casing string, comprising:

a drill bit having a working face, wherein a cross section of said working face defines a maximum diameter;

a centralizing sub operatively interconnected to said drill bit such that said centralizing sub rotates with said drill bit, wherein said centralizing sub is a drill collar, said centralizing sub having:

a plurality of immovable, non-cutting vanes adapted to contact an inner surface of said casing string to centralize said drill bit above said obstruction, wherein a cross section of said plurality of immovable, non-cutting vanes defines a maximum diameter that is larger than said maximum diameter of said working face of said drill bit;

a plurality of channels, wherein each channel is positioned between two vanes of said plurality of immovable, non-cutting vanes to facilitate removal of debris from said obstruction.

2. The bottom hole drilling assembly of claim 1, wherein each vane of said plurality of immovable, non-cutting vanes is oriented non-parallel to a longitudinal axis of said centralizing sub.

3. The bottom hole drilling assembly of claim 1, wherein said centralizing sub has a second plurality of immovable, non-cutting vanes spaced apart from said first plurality of immovable, non-cutting vanes along a longitudinal axis of said centralizing sub, wherein a cross section of said second plurality of immovable, non-cutting vanes defines a maximum diameter that is larger than said maximum diameter of said working face, wherein each vane of said second plurality of immovable, non-cutting vanes is oriented non-parallel to said longitudinal axis of said centralizing sub.

4. The bottom hole drilling assembly of claim 1, further comprising at least one insert extending from an outermost housing of said drill bit to provide a contact surface to engage said inner surface of said casing string, wherein said at least one insert has a coating with a friction coefficient that is less than a friction coefficient of said centralizing sub.

* * * * *